US007642881B1

(12) United States Patent
Robinson et al.

(10) Patent No.: US 7,642,881 B1
(45) Date of Patent: Jan. 5, 2010

(54) VANADIUM OXIDE RF/MICROWAVE INTEGRATED SWITCH SUITABLE FOR USE WITH PHASED ARRAY RADAR ANTENNA

(75) Inventors: Kevin L. Robinson, Clay, NY (US); William H. Huber, Scotia, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 316 days.

(21) Appl. No.: 11/371,174

(22) Filed: Mar. 8, 2006

(51) Int. Cl.
*H01P 1/15* (2006.01)

(52) U.S. Cl. ..... 333/104; 333/262; 257/108; 257/43

(58) Field of Classification Search ..... 333/101, 333/103, 104, 262; 257/108, 43
See application file for complete search history.

(56) References Cited

U.S. PATENT DOCUMENTS 4,906,956 A * 3/1990 Kakihana ..... 333/246

OTHER PUBLICATIONS

Sovero, E. et al; "Fast Thin Film Vanadium Oxide Microwave Switches"; Proceedings of the Gallium Arsenide Integrated Circuit Symposioum. (GaAs IC); U.S. New York, IEEE Bd. SYMP. 12; Oct. 7, 1990; pp. 101-103.*

* cited by examiner

*Primary Examiner*—Benny Lee
(74) *Attorney, Agent, or Firm*—Howard IP Law Group, PC

(57) ABSTRACT

A circuit including: at least one radio frequency microstrip conductor; and, a least one vanadium oxide region electrically coupled to the at least one radio frequency microstrip conductor; wherein, the at least one vanadium oxide region is substantially conductive in a first temperature range, and substantially non-conductive in a second temperature range.

18 Claims, 8 Drawing Sheets

"Prior Art"

(a)

(b)

(a)

(b)

VANADIUM OXIDE RF/MICROWAVE INTEGRATED SWITCH SUITABLE FOR USE WITH PHASED ARRAY RADAR ANTENNA

FIELD OF INVENTION

The present invention relates to a switch apparatus for high frequency signals, and particularly to an apparatus for switching between transmit and receive modes in phased array radar devices.

BACKGROUND OF THE INVENTION

Phased array radar antennas are generally known and implemented. Phased array antennas include apertures formed from a multitude of radiating elements. Each element is individually controlled in phase and amplitude. In this manner, desired radiating patterns and directions may be achieved. By rapidly switching the elements to switch beams, multiple radar functions may be realized.

Referring now to FIG. 1, there is shown a conventional transmit/receive switching circuit arrangement 100 for a phased array radar antenna. Circuit 100 includes a microstrip coupled to an input terminal P1 and to a transmit terminal P3 and capacitors 120, 130. "Microstrip", as used herein, generally refers to a transmission line used for transmitting high frequency signals, such as radio frequency or microwave frequency signals. A microstrip may typically take the form of a thin, strip-like transmission line mounted on a flat dielectric substrate, that is in-turn mounted on a ground plane. Capacitors 120, 130 are coupled to a receive terminal P2, a bias terminal BIAS, and ground through radio frequency (RF) diodes 140, 150. Transmit terminal P3 is coupled to a waste load 110.

When a sufficiently positive bias BIAS is provided, diodes 140, 150 essentially provide short-circuit conditions, such that signals are steered from input terminal P1 to transmit terminal P3 and hence waste load 110. When a sufficiently negative bias BIAS is provided, diodes 140, 150 essentially provide open circuit conditions, such that signals are steered to receive terminal P2. Circuitry 100 and its operation are generally known in the phased-array radar arts.

However, such a configuration and operation undesirably introduces signal losses, due to the incorporation of wires, jumpers and materials that affect RF performance and compromise circuit performance. Accordingly, it is desirable to eliminate these wires, jumpers and materials, such as those associated with the depicted diodes, while maintaining selective transmit and receive functionalities.

SUMMARY OF THE INVENTION

A circuit including: at least one high frequency microstrip conductor; and, a least one vanadium oxide region electrically coupled to the at least one radio frequency microstrip conductor; wherein, the at least one vanadium oxide region is substantially conductive in a first temperature range, and substantially non-conductive in a second temperature range.

BRIEF DESCRIPTION OF THE DRAWINGS

Understanding of the present invention will be facilitated by consideration of the following detailed description of the preferred embodiments taken in conjunction with the accompanying drawings, wherein like numerals refer to like parts and.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for the purpose of clarity, many other elements found in typical radar antenna arrays and signal processing systems. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

Figure 1:
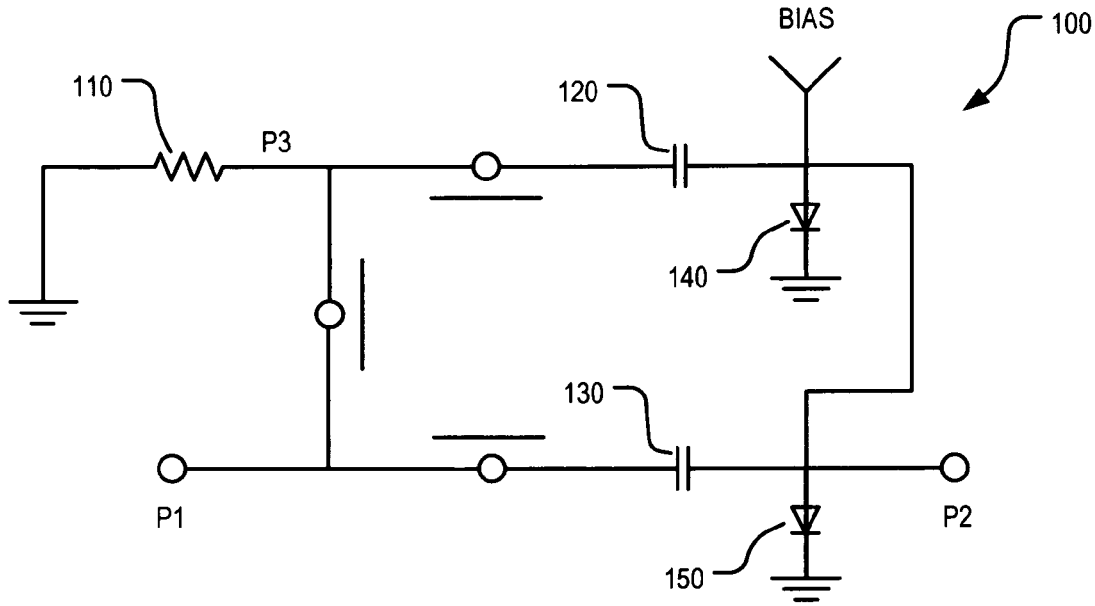
FIG. 1 illustrates a diagram of conventional phased-array radar transmit/receive switching circuitry.
Figure 2:
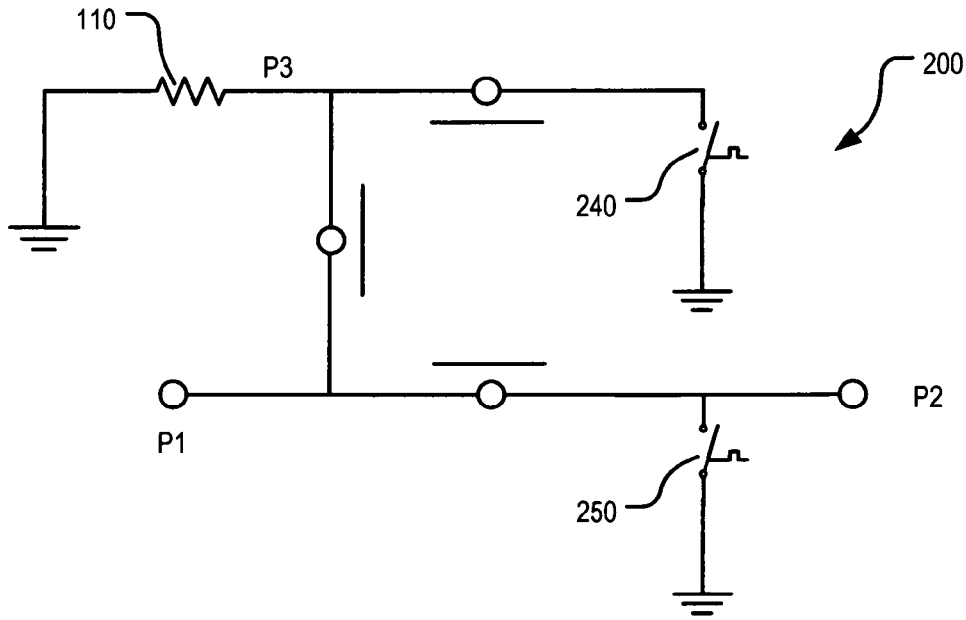
FIG. 2 illustrates a diagram of phased-array radar transmit/receive switching circuit arrangement according to an aspect of the present invention.

Referring now to FIG. 2, there is shown phased-array antenna transmit/receive switching circuit 200 according to an aspect of the present invention. Circuit 200 includes a microstrip coupled to an input terminal P1 and a transmit terminal P3 and receive terminal P2, and ground through switching devices 240, 250. Transmit terminal P3 is coupled to waste load 110.

Switching devices 240, 250 may be operated in a first mode, that essentially provides a low resistance condition, such that signals are steered from input terminal P1 to transmit terminal P3, and hence waste load 110. Switching devices 240, 250 may be operated in a second mode, that essentially provides a high resistance condition, such that signals are steered to receive terminal P2. In the illustrated case, switching devices 240, 250 are temperature dependent. Consistently, subjecting devices 240, 250 to a first temperature range effects their operation in the first mode to have a first conductance, while subjecting them to a second temperature range effects their operation in the second mode to have a second conductance.

As will be understood by those possessing an ordinary skill in the pertinent arts, such a control mechanism is separate from the RF signal path. Accordingly, such an approach advantageously may omit the above-discussed wires, jumpers and materials that affect RF performance and compromise circuit performance.

According to an aspect of the present invention, switching devices 240, 250 may take the form of vanadium oxide interconnections, such as vanadium (IV) oxide ($VO_2$) material containing interconnections. Other vanadium oxide materials, such as vanadium (II) oxide (VO), vanadium (III) oxide ($V_2O_3$) and vanadium (V) oxide ($V_2O_5$) may also be suitable for use. The present invention will be further discussed as it relates to vanadium (IV) oxide, for non-limiting purposes of explanation.

Figure 3:
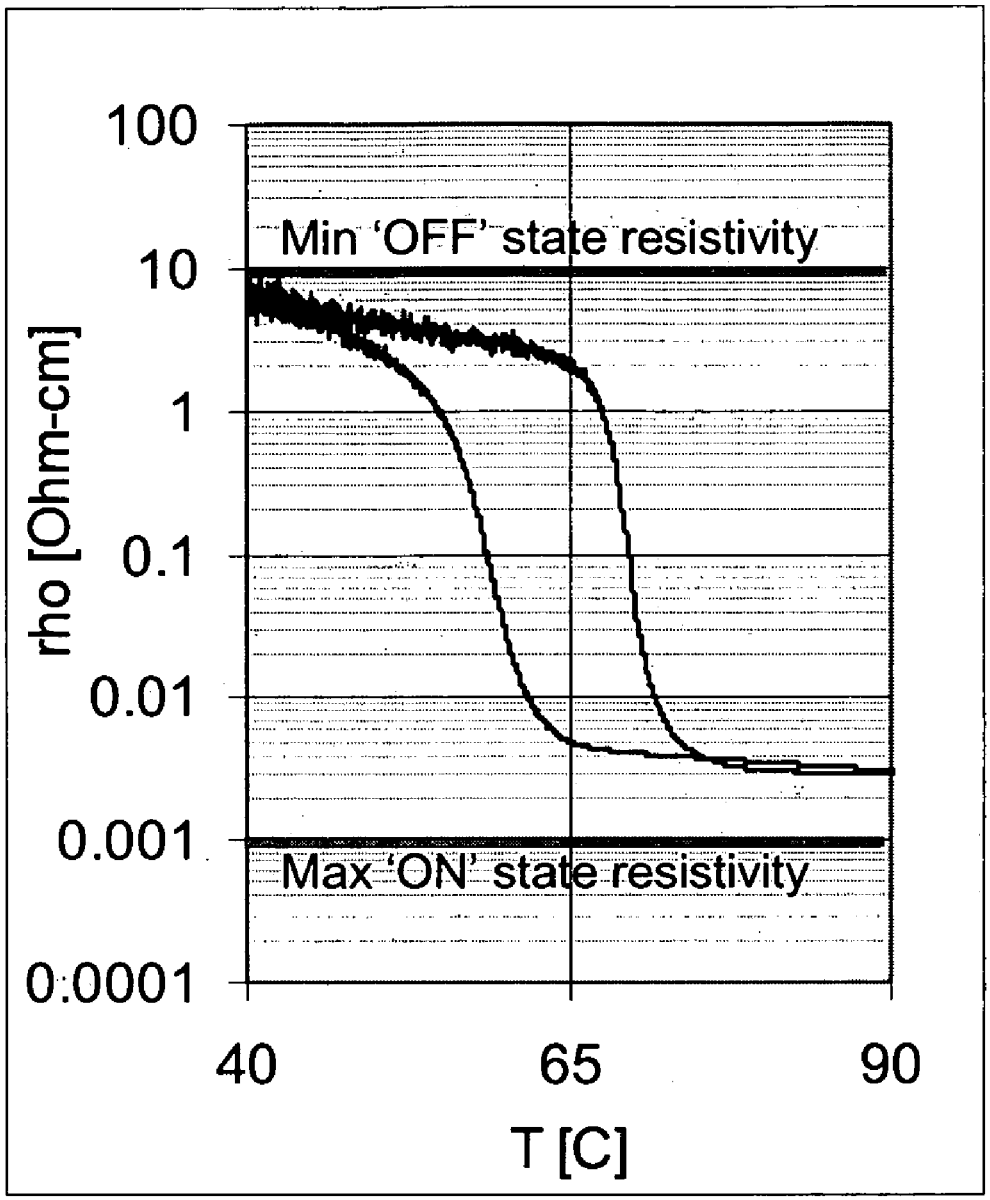
FIG. 3 illustrates a $VO_2$ interdependence of resistance and temperature that may be used according to an aspect of the present invention.

Referring now also to FIG. 3, there is shown the resistivity (rho in Ω-cm) of $VO_2$ as a function of temperature (T in ° C.) between a theoretical maximum resistivity in an "ON" state and a theoretical minimum resistivity in an "OFF" state. As may be ascertained therefrom, $VO_2$ has a resistivity corresponding to a high conductance, or almost a short-circuit or on-state condition, e.g., the first mode (e.g., <0.01 Ω-cm), in a temperature range above about 72° C. Further, $VO_2$ has a resistivity corresponding to a low conductance, or almost an open-circuit or off-state condition, e.g., the second mode (e.g., >1 Ω-cm), in a temperature range less than about 62° C. Accordingly, a $VO_2$ based electrical interconnection may be selectively operated in the first and second modes (e.g., on and off states) by selectively controlling the temperature thereof to be within these temperature ranges (e.g., the above-identified first and second temperature ranges). For example, a $VO_2$ based electrical interconnection may be selectively operated in the first mode by making the temperature thereof around 80° C. And, the same $VO_2$ based electrical interconnection may be selectively operated in the second mode by making the temperature thereof around 60° C.

According to an aspect of the present invention, the temperature of $VO_2$ based electrical interconnections may be selectively altered using any suitable heating and/or cooling means, such as resistive based heaters, thermal electric coolers, thermo ionic micro-coolers and/or radiant heaters. Resistive heaters and thermal electric coolers are generally known. For example, the entire circuit 200 may be brought to around 60° C., using a conventional heating/cooling approach, while $VO_2$ regions are selectively heated to around 80° C. using resistive heaters positioned near (e.g., above, below and/or alongside) them. Another suitable approach, using thermo ionic coolers is presented in co-pending, commonly assigned, U.S. patent application Ser. No. 11/370,766, entitled SWITCH APPARATUS, filed Mar. 8, 2006, the entire disclosure of which is hereby incorporated by reference herein.

As will be recognized by those possessing an ordinary skill in the pertinent arts, such an approach to switching high frequency (e.g., RF or microwave) signals is applicable to a wide variety of implementations. Non-limiting examples are presented herein for purposes of further explanation.

Figure 4:
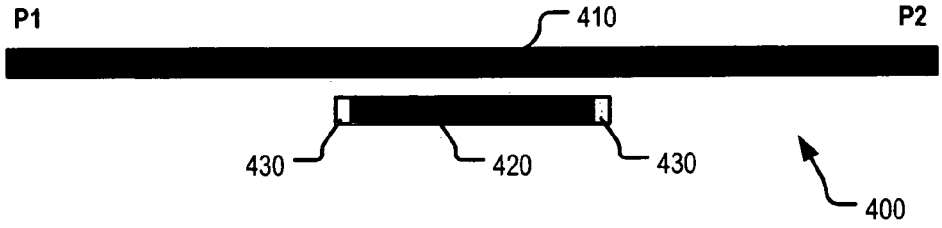
FIG. 4 illustrates a circuit arrangement according to an aspect of the present invention.

Referring now to FIG. 4, there is shown a half-wave resonator circuit structure 400 according to an aspect of the present invention. Half-wave resonators are known to be useful in RF signal applications, including phased-array radar antenna transmit/receive applications. Structure 400 includes a gold microstrip transmission line 410 disposed upon an alumina substrate and extending between terminals P1 and P2. Structure 400 also includes a conductive line 420. Line 420 may also be formed of gold, for example. Electrically coupled to one or more ends of line 420, are interconnects 430. In the illustrated embodiment, interconnects 430 take the form of $VO_2$ regions. As is known, the resonant frequency of a half-wave resonator is dependent upon the length of the resonator itself. By altering the length of the resonator (e.g., line 420), the resonance frequency also changes.

Figure 5:
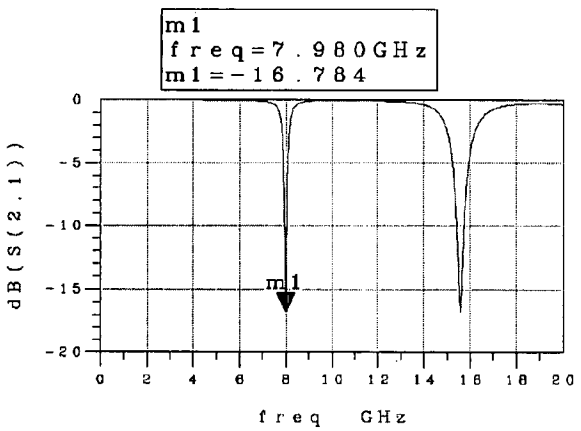
FIGS. 5*a* and 5*b* illustrate predicted operational characteristics of the arrangement of FIG. 4 in first and second modes.
Figure 5:
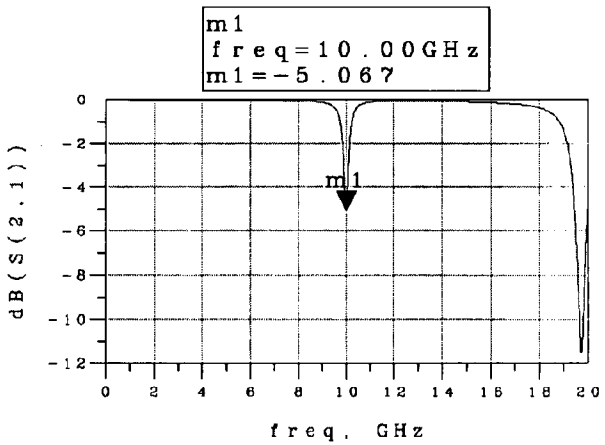

Referring now also to FIGS. 5A and 5B, there are shown non-limiting exemplary illustrations of a predicted resonance with the $VO_2$ interconnects in the first mode or "on" state (FIG. 5A), and in the second mode or "off" state (FIG. 5B). Predicted resonance in "on" state is represented by point m1 having frequency of about 7.980 GHz and amplitude of about −16.784 dB in FIG. 5A whereas the predicted resonance in "off" state is represented by point m1 having a frequency of about 10.000 GHz and amplitude of about −5.067 dB in FIG. 5B. It is predicted that the resonance frequency of resonator 400 may be changed from 10 GHz (in an "off" state) to 7.980 GHz (in an "on" state) by thermally transitioning regions 430 from the second mode to the first mode (e.g., changing the temperature thereof from 60° C. to 80° C.), for example.

Figure 6:
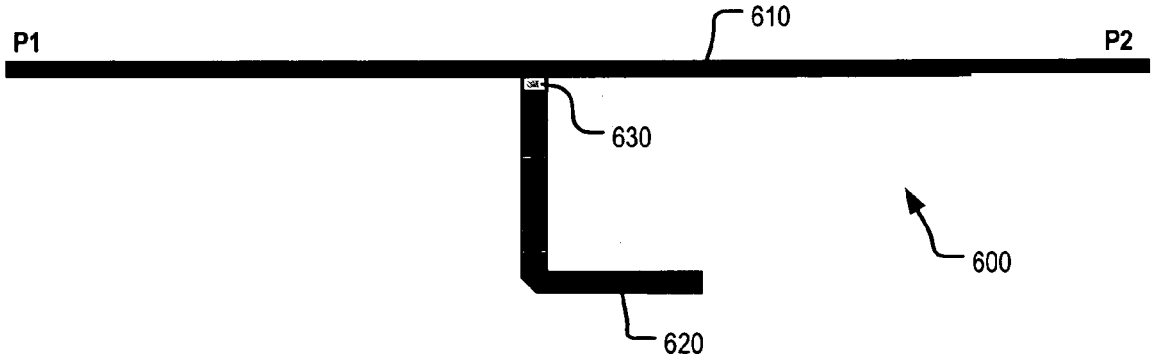
FIG. 6 illustrates a circuit arrangement according to an aspect of the present invention.

Referring now also to FIG. 6, there is shown a half-frequency trap circuit structure 600 according to an aspect of the present invention. Half-frequency traps are also known to be useful in RF signal applications. Structure 600 includes a gold microstrip transmission line 610 upon an alumina substrate that extends between terminals P1 and P2. Structure 600 also includes a conductive trap line 620, that may be formed of gold, for example. Electrically coupled between trap line 620 and line 610 is interconnect 630. In the illustrated embodiment, interconnect 630 takes the form of a $VO_2$ region.

Figure 7:
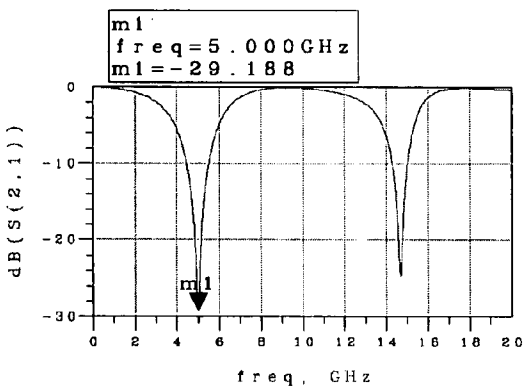
FIGS. 7*a* and 7*b* illustrate predicted operational characteristics of the arrangement of FIG. 6 in first and second modes according to an aspect of the present invention.
Figure 7:
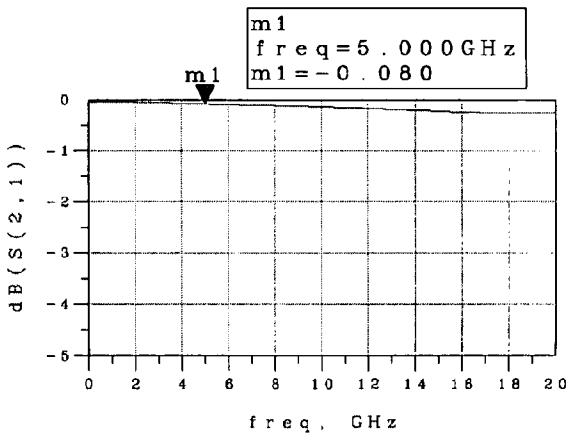

Referring now also to FIGS. 7A and 7B, it is predicted the trap may be engaged by thermally transitioning region 630 from the second mode to the first mode (e.g., changing the temperature thereof from 60° C. to 80° C.), thereby changing the operational characteristics of structure 600 (FIG. 7A is with the $VO_2$ conductor on, FIG. 7B is with the $VO_2$ conductor off). Point m1 of FIG. 7A represents a frequency of 5.000 GHz at an amplitude of −29.188 dB, when the $VO_2$ conductor is on whereas point m1 represents a frequency of 5.000 GHz at an amplitude of −0.080 dB in FIG. 7B when the $VO_2$ conductor is off.

FIG. 6 illustrates a structure useful for switching entire circuit regions or elements into the circuit including line 610. While FIG. 6 illustrates a trap that is selectively switchable into and out of the circuit including line 610, other circuit elements could be switched in and out as well. Such an approach may be used to realize circuit 200 of FIG. 2.

Figure 8:
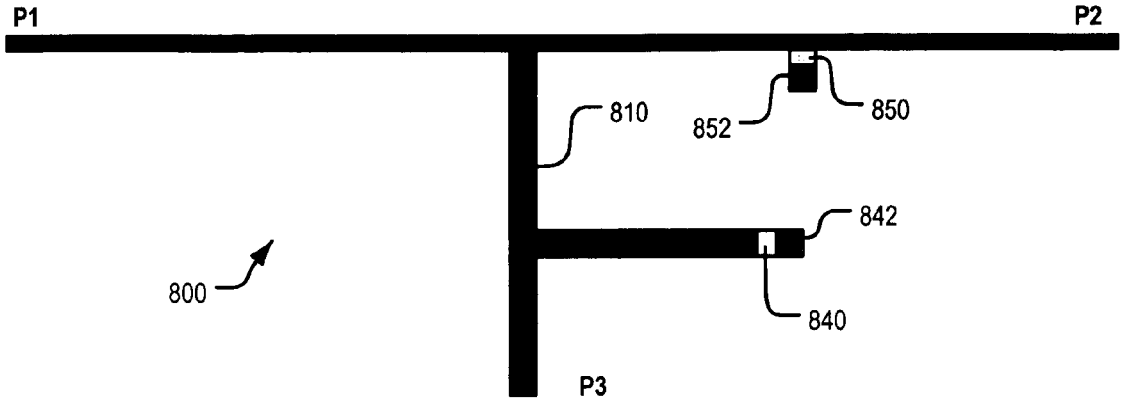
FIG. 8 illustrates a circuit arrangement according to an aspect of the present invention.

Referring now also to FIG. 8, there is shown a $VO_2$ interconnect employing embodiment 800 of circuit 200 (FIG. 2). Structure 800 includes a gold microstrip transmission line 810 disposed upon an alumina substrate and extending between terminals P1, P2 and P3. As may be seen therein, $VO_2$ interconnect region 840 may be used to implement switch 240 (FIG. 2), while $VO_2$ interconnect region 850 may be used to implement switch 250 (FIG. 2). As will be understood by those possessing an ordinary skill in the pertinent arts gold lines 842, 852 may be coupled to ground.

Figure 9:
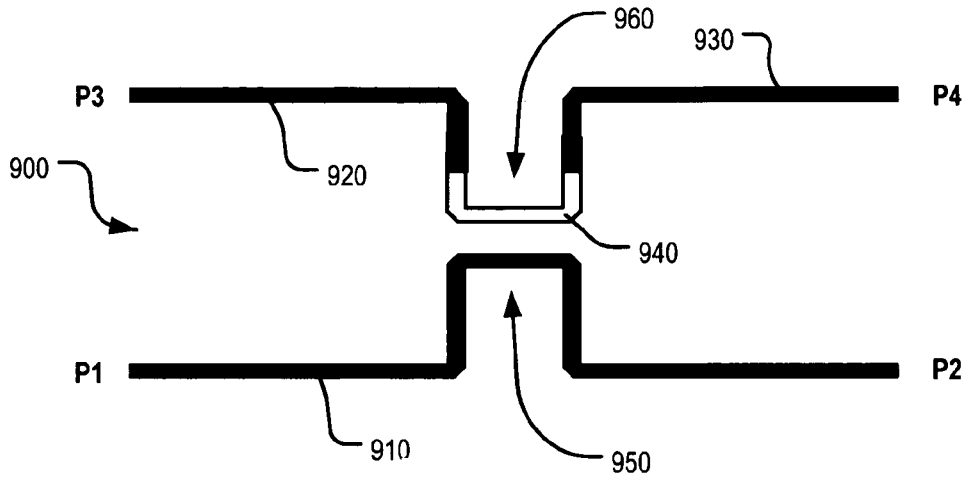
FIG. 9 illustrates a circuit configuration according to an aspect of the present invention.

Referring now also to FIG. 9, there is shown a ¼ wave coupler circuit structure 900 incorporating $VO_2$ interconnections. Structure 900 includes input and through nodes P1, P2. Structure 900 also includes a ¼ wave coupled node P3 and an isolated node P4. Nodes P1, P2 are coupled to one another using a gold microstrip 910 upon an alumina substrate. Microstrip 910 includes a conventional ¼ wave coupling region 950. Sufficiently proximate to coupling region to effect coupling when in a conductive mode, is a $VO_2$ interconnect 940. Interconnect 940 may take the shape of a conventional ¼ wave coupling region 960. A gold microstrip 920 couples node P3 to $VO_2$ interconnect 940. A gold microstrip 930 couples node P4 to $VO_2$ interconnect 940. When interconnect 940 is thermally activated to be conductive, conventional ¼ wave coupling from node P1 to node P3 is effected. When interconnect 940 is not conductive, e.g., in the above-identified second mode, node P1 is essentially isolated from node P3. Thus, as described above, a great number of high frequency circuit interconnections may be effected using thermal dependent switching according to an aspect of the present invention, while eliminating conventional circuit interconnects that may otherwise lead to undesirable signal losses.

According to an aspect of the present invention, $VO_2$ interconnections and gold conductive lines may be formed on an alumina substrate using the following methodology. For example, $VO_2$ interconnects and gold conductive lines may be formed on a substrate using conventional photolithography and etch processes. An about 500 nm thick film of metallic vanadium may then be deposited on the patterned substrate using a suitable thin film deposition process, such as resistive (thermal) evaporation, e-beam evaporation or sputtering. The film may then be annealed in about 110 mTorr of Oxygen at about 560 C for about 24 hours, to create vanadium oxide. The film may then be patterned using conventional photolithography and etching, or direct write lithography, to the desired geometry.

Figure 10:
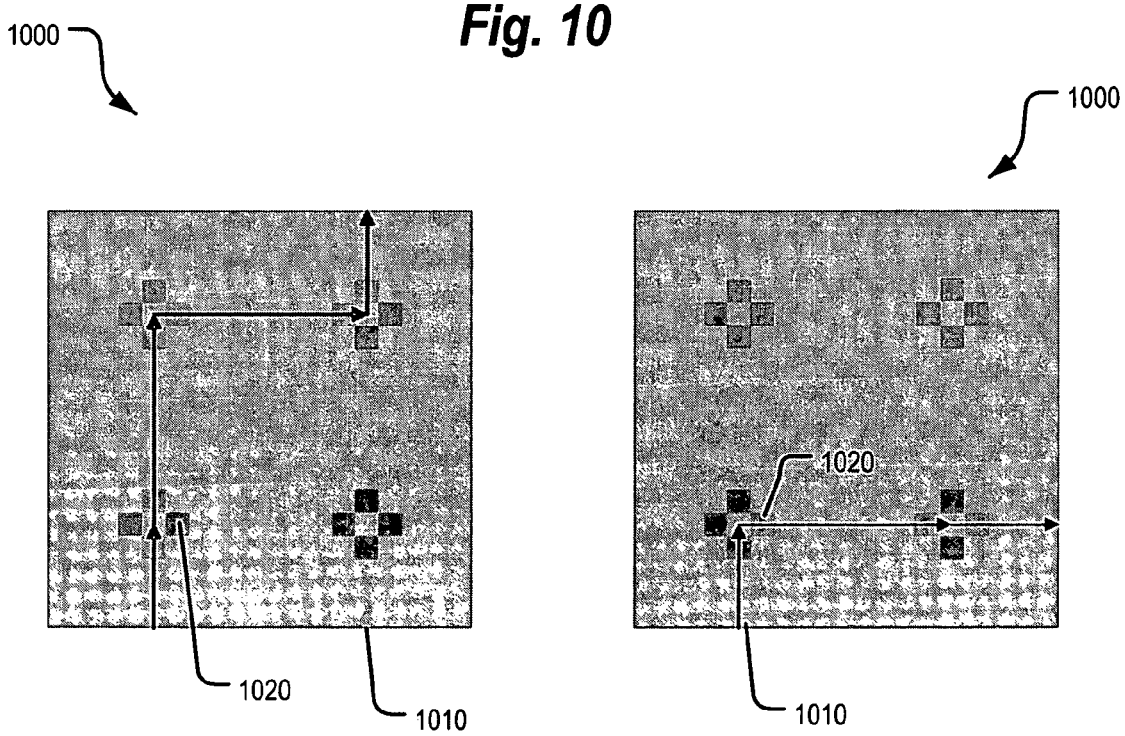
FIG. 10 illustrates a circuit configuration according to an aspect of the present invention.

As will be understood by those possessing an ordinary skill in the pertinent arts, vanadium oxide interconnections have many other uses as well. For example, and referring now also to FIG. 10, an array 1000, such as a two-dimensional or three-dimensional array of conductors 1010 may include integrated $VO_2$ regions 1020 that provide for dynamically reconfigurable signal paths. This may prove particularly advantageous for switching between modules in dual-band radar applications, such as for L-band and x-band signal paths.

Figure 11:
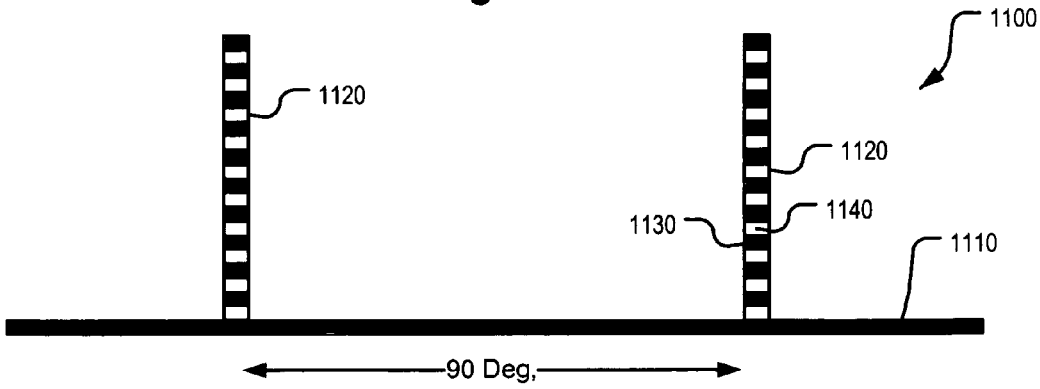
FIG. 11 illustrates a circuit configuration according to an aspect of the present invention.

By way of further, non-limiting example, and referring now also to FIG. 11, RF phase shifting may be accomplished using structure 1100. Structure 1100 includes gold conductor 1110 and variable length conductive lines 1120. Each variable length line 1120 includes selectively conductive $VO_2$ regions 1130, 1140. Other conductive line portions may optionally be included. The variable length of one or more of the lines 1120 may be used to tune a phase shift, as will be understood by those possessing an ordinary skill in the pertinent arts. By selectively turning on and off selectively conductive VO2 regions 1130, 1140 in two illustrated exemplary lines 1120, a phase shift of 90 degrees may be achieved.

Figure 12:
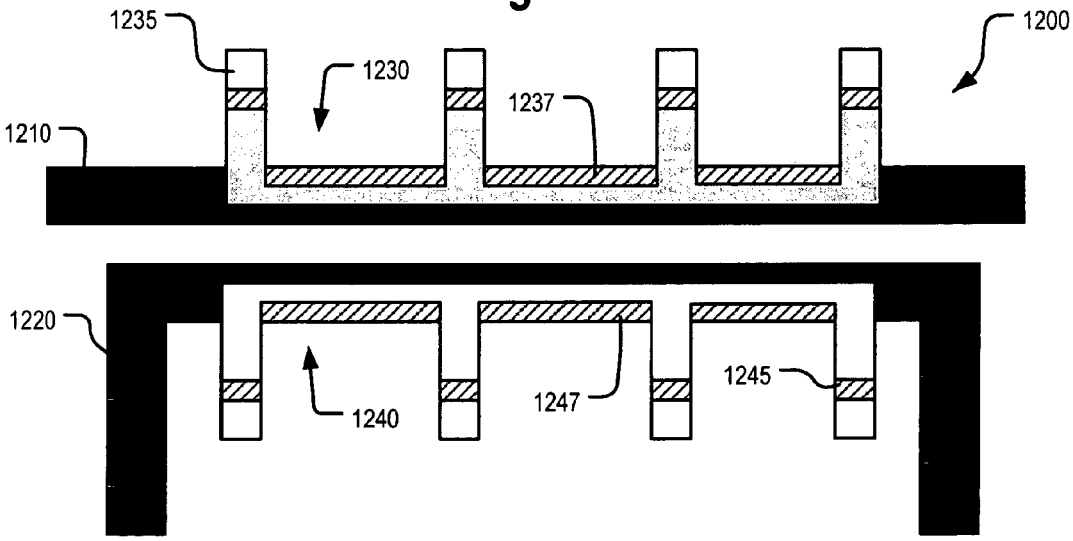
FIG. 12 illustrates a circuit configuration according to an aspect of the present invention.

Coupler tuning may also be accomplished using $VO_2$ regions. FIG. 12 illustrates a structure 1200 including conductive lines 1210, 1220. Lines 1210, 1220 may be formed of gold, for example. Structure 1200 also includes $VO_2$ material structures 1230, 1240. Structures 1230 include variable length lines 1235, akin to lines 1120 of FIG. 11, and variable depth slots 1237, also akin to shortened lines 1120 of FIG. 11. Structure 1240 includes lines 1245 and slots 1247. As will be understood by those possessing an ordinary skill in the pertinent arts, active fine tuning of combiner directivity for increased high power combiner efficiency over frequency can be realized using structure 1200. The variable conductive length of conductive lines 1235, 1245 may be used to vary the even mode impedance, while the variable conductive depth of slots 1237, 1247 may be used to vary the odd mode impedance.

Figure 13:
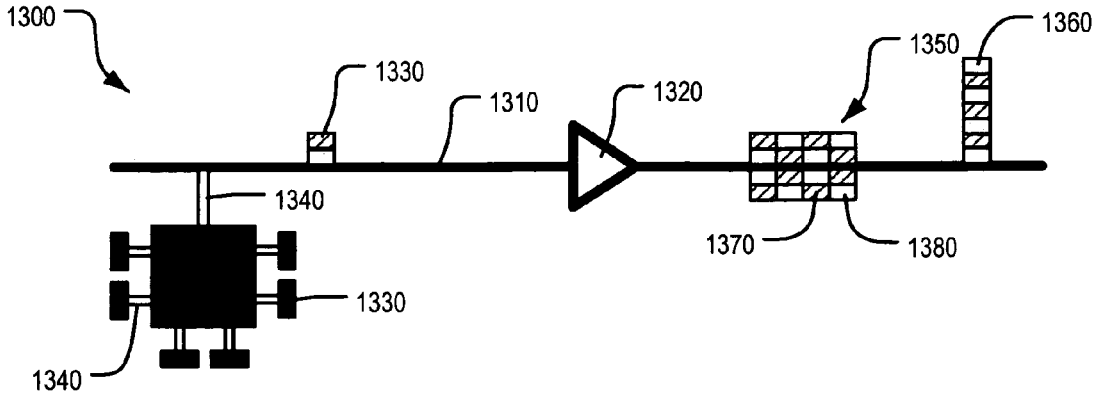
FIG. 13 illustrates a circuit configuration according to an aspect of the present invention; and, FIG. 14 illustrates a circuit configuration according to an aspect of the present invention.

A yet further example is provided in FIG. 13, which illustrates $VO_2$ interconnects being used to provide for amplifier tuning. FIG. 13 illustrates a structure 1300 including a conductor 1310 and amplifier 1320. Structure 1300 also includes $VO_2$ material regions 1330, 1350 and 1360, and interconnects 1340. Regions 1330 may be individually thermally controlled to selectively add capacitance to circuit 1300. Interconnects 1340 may be individually thermally controlled to selectively couple additional capacitance (represented by elements 1370, 1380) into structure 1300. Regions 1350 may be individually thermally controlled to selectively add inductance into structure 1300. Regions 1360 may be individually thermally controlled to selectively change the harmonic tuning of structure 1300.

Figure 14:
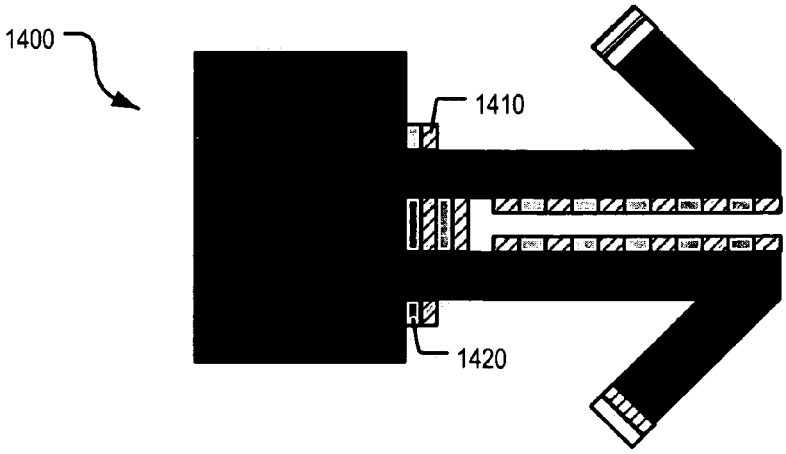

Referring now to FIG. 14, and by way of yet further non-limiting exemplary implementation, $VO_2$ regions may be individually thermally actuated to provide for phased array radar antenna element tuning. FIG. 14 illustrates a structure 1400. Structure 1400 generally includes a conventional dipole and ground plane. $VO_2$ regions 1410, 1420 may be individually thermally controlled to selectively modify the dipole dimension and ground plane spacing to improve matching at select frequencies.

While the foregoing invention has been described with reference to the above-described embodiment, various modifications and changes can be made without departing from the spirit of the invention. Accordingly, all such modifications and changes are considered to be within the scope of the appended claims.

What is claimed is:

1. A circuit comprising:

at least one microstrip conductor for conveying a signal;

a least one vanadium oxide region electrically coupled to said at least one microstrip conductor, wherein, said at least one vanadium oxide region is substantially conductive in a first temperature range, and substantially non-conductive in a second temperature range; and, another conductor positioned substantially proximate to said at least one vanadium oxide region to be electromagnetically coupled thereto when in said first temperature range.

2. The circuit of claim 1, further comprising input and output terminals electrically coupled to said another conductor, and a ¼ wave coupled terminal electrically coupled to said at least one high frequency signal microstrip conductor.

3. The circuit of claim 1, wherein said first temperature range includes 80 degrees Celsius and said second temperature range includes 60 degrees Celsius.

4. The circuit of claim 1, wherein said at least one vanadium oxide region comprises at least one of: $VO_2$, VO, $V_2O_3$ and $V_2O_5$.

5. A circuit comprising:

at least one microstrip conductor for conveying a signal; and, a plurality of vanadium oxide regions serially coupled to said at least one microstrip conductor;

wherein, at least one vanadium oxide region of said plurality of vanadium oxide regions is substantially conductive in a first temperature range, and substantially non-conductive in a second temperature range.

6. The circuit of claim 5, wherein a phase shift characteristic associated with the circuit is dependent upon said plurality of vanadium oxide regions being in said first temperature range or second temperature range.

7. The circuit of claim 5, wherein said first temperature range includes 80 degrees Celsius and said second temperature range includes 60 degrees Celsius.

8. The circuit of claim 5, wherein said plurality of vanadium oxide regions comprises at least one of: $VO_2$, VO, $V_2O_3$ and $V_2O_5$.

9. A circuit comprising:

at least one microstrip conductor for conveying a signal;

a least one vanadium oxide region electrically coupled to said at least one microstrip conductor; and, a second conductor electromagnetically coupled to said at least one microstrip conductor;

wherein, said at least one vanadium oxide region is substantially conductive in a first temperature range, and substantially non-conductive in a second temperature range.

10. The circuit of claim 9, wherein said at least one vanadium oxide region comprises at least one of: $VO_2$, VO, $V_2O_3$ and $V_2O_5$.

11. The circuit of claim 9 wherein said first temperature range includes 80 degrees Celsius and said second temperature range includes 60 degrees Celsius.

12. The circuit of claim 9, wherein said circuit has a first resonance characteristic with said at least one vanadium oxide region in said first temperature range and a second resonance characteristic with said at least one vanadium oxide region in said second temperature range, and said first and second resonance characteristics are different.

13. A circuit comprising:

at least one microstrip conductor for conveying a signal; and, an array of vanadium oxide regions interconnected by a plurality of conductors;

wherein, at least one vanadium oxide region of said array of vanadium oxide regions is substantially conductive in a first temperature range, and substantially non-conductive in a second temperature range.

14. The circuit of claim 13, wherein said array is a two-dimensional array.

15. The circuit of claim 13, wherein said first temperature range includes 80 degrees Celsius and said second temperature range includes 60 degrees Celsius.

16. The circuit of claim 13, wherein said array of vanadium oxide regions comprises at least one of: $VO_2$, VO, $V_2O_3$ and $V_2O_5$.

17. An amplifier tuning circuit comprising:

a first microstrip conductor for conveying a signal;

an amplifier coupled to said first microstrip conductor; and pluralities of vanadium oxide regions and interconnects coupled to said first microstrip conductor, wherein, at least one vanadium oxide region of each of said pluralities of vanadium oxide regions is substantially conductive in a first temperature range, and substantially non-conductive in a second temperature range, and wherein a characteristic associated with the circuit is dependent upon said plurality of vanadium oxide regions being in said first temperature range or in said second temperature range, the characteristic selected from one of capacitance, inductance, and harmonic tuning.

18. A coupler tuning circuit comprising:

first and second microstrip conductors for conveying a signal; and first and second pluralities of vanadium oxide regions coupled to said first and second microstrip conductors, wherein, at least one vanadium oxide region of each of said first and second pluralities of vanadium oxide regions is substantially conductive in a first temperature range, and substantially non-conductive in a second temperature range, and wherein an impedance characteristic associated with the circuit is dependent upon said first and second pluralities of vanadium oxide regions being in said first temperature range or said second temperature range.

* * * * *

UNITED STATES PATENT AND TRADEMARK OFFICE

CERTIFICATE OF CORRECTION

PATENT NO. : 7,642,881 B1
APPLICATION NO. : 11/371174
DATED : January 5, 2010
INVENTOR(S) : Robinson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 619 days.

Signed and Sealed this

Sixteenth Day of November, 2010

David J. Kappos

David J. Kappos
*Director of the United States Patent and Trademark Office*